US008584597B2

(12) United States Patent
DeLacerda et al.

(10) Patent No.: US 8,584,597 B2
(45) Date of Patent: Nov. 19, 2013

(54) SELF-LATCHING COVER MECHANISM

(75) Inventors: Jeremy DeLacerda, Elmer, LA (US); Randy McDougal, Boyce, LA (US); James A. Warwick, Boyce, LA (US)

(73) Assignee: UTLX Manufacturing LLC, Alexandria, LA (US)

( * ) Notice: Subject to any disclaimer, the term of this patent is extended or adjusted under 35 U.S.C. 154(b) by 0 days.

(21) Appl. No.: 13/543,986

(22) Filed: Jul. 9, 2012

(65) Prior Publication Data

US 2013/0008339 A1 Jan. 10, 2013

Related U.S. Application Data

(60) Provisional application No. 61/505,375, filed on Jul. 7, 2011.

(51) Int. Cl.
*B61D 39/00* (2006.01)

(52) U.S. Cl.
USPC ..... 105/377.07; 105/377.01

(58) Field of Classification Search
USPC ..... 105/377.01–377.08
See application file for complete search history.

(56) References Cited

U.S. PATENT DOCUMENTS

| | | | | | |
|---|---|---|---|---|---|
| 1,776,168 | A * | 9/1930 | Sweeley et al. | ..... | 105/377.07 |
| 3,485,524 | A * | 12/1969 | Nelson | ..... | 296/100.1 |
| 4,613,174 | A * | 9/1986 | Berg et al. | ..... | 292/136 |
| 4,889,056 | A * | 12/1989 | Stewart | ..... | 105/377.11 |
| 4,941,695 | A * | 7/1990 | Miller | ..... | 292/256.5 |
| 7,131,455 | B2 * | 11/2006 | Horban et al. | ..... | 137/350 |
| 7,427,089 | B2 * | 9/2008 | Silverio et al. | ..... | 292/256.5 |
| 7,770,526 | B2 * | 8/2010 | Drager | ..... | 105/377.07 |
| 8,225,721 | B2 * | 7/2012 | Hunter | ..... | 105/377.07 |
| 2007/0234926 | A1 * | 10/2007 | Brewster | ..... | 105/377.01 |
| 2009/0158959 | A1 * | 6/2009 | Schultz et al. | ..... | 105/377.07 |
| 2010/0107926 | A1 * | 5/2010 | Drager | ..... | 105/377.07 |
| 2013/0008339 | A1 * | 1/2013 | DeLacerda et al. | ..... | 105/377.07 |

* cited by examiner

*Primary Examiner* — Jason C Smith
(74) *Attorney, Agent, or Firm* — R. Blake Johnston, Esq.; DLA Piper LLP US

(57) ABSTRACT

A self-latching cover mechanism includes a nozzle having a central opening and a cover. A hinge pivotally attaches the cover to the nozzle so that the cover may be pivoted between an open position, where the central opening is generally uncovered, and a closed position, where the central opening is generally covered by the cover. A catch member is attached to the cover. A latching arm is movably attached to the nozzle and engages the catch member when the cover is in the open position.

19 Claims, 8 Drawing Sheets

22

SELF-LATCHING COVER MECHANISM

CLAIM OF PRIORITY

This application claims priority from U.S. Provisional Patent Application Ser. No. 61/505,375, filed Jul. 7, 2011, currently pending.

FIELD OF THE INVENTION

The present invention relates generally to covers providing access to the interiors or fittings of tanks and, more particularly, to a mechanism that automatically latches such a cover when it is placed in an open position.

While the invention is described below in terms of a manway cover of a railroad tank car, the present invention may be used on any access or top fittings cover of a railroad tank car or other vehicle tank or tank installation or on a cover for any other type of passageway.

DETAILED DESCRIPTION OF EMBODIMENTS

Figure 1:
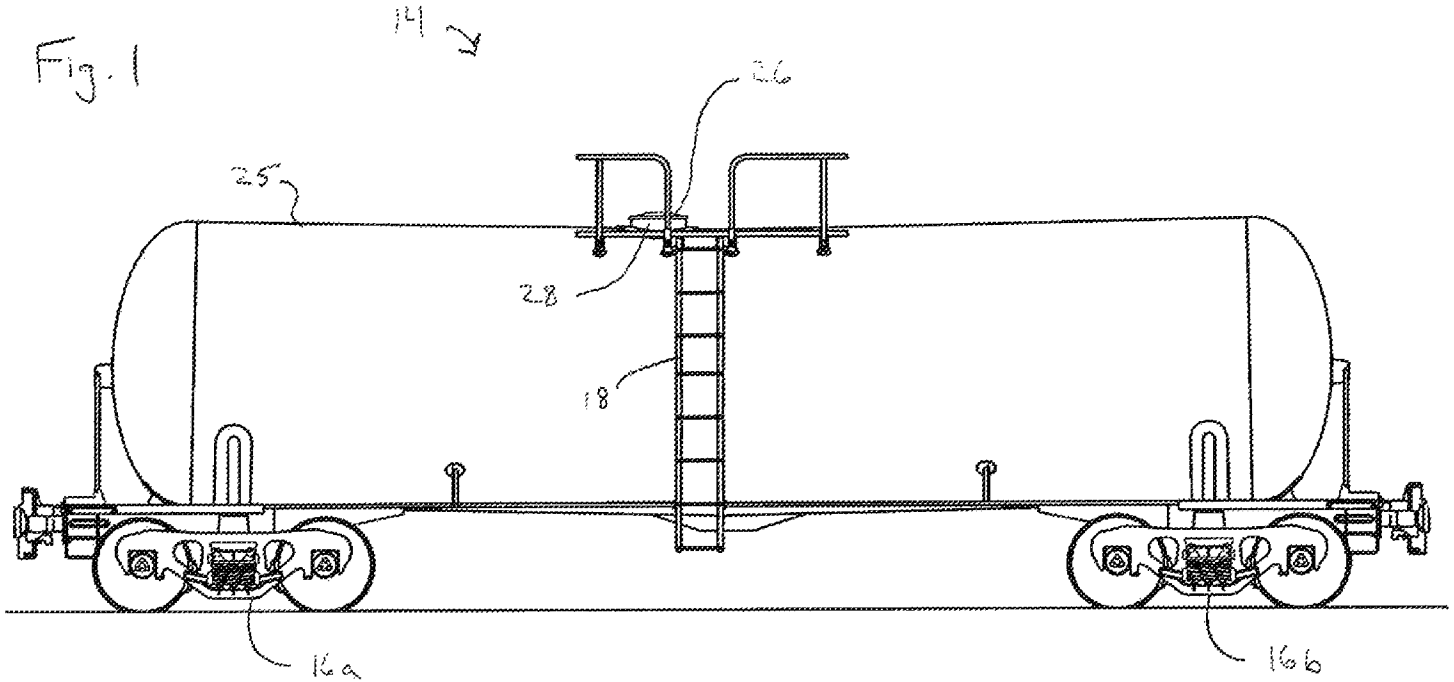
FIG. 1 is a side elevational view of a railroad tank car equipped with a nozzle and a manway cover and embodiment of the mechanism of the present invention.

A typical general purpose, non-pressurized railroad tank car suitable for use with the present invention is indicated in general at 14 in FIG. 1. The tank car features a tank body 25 mounted on a pair of wheel trucks 16*a* and 16*b*. As illustrated in FIG. 1, a manway cover 26 is positioned on top of a nozzle 28 which is mounted on the tank body 25. As is known in the art, the manway cover pivots open and may be accessed by a ladder 18. The manway cover permits access to the interior of the tank body 25.

Figure 2A:
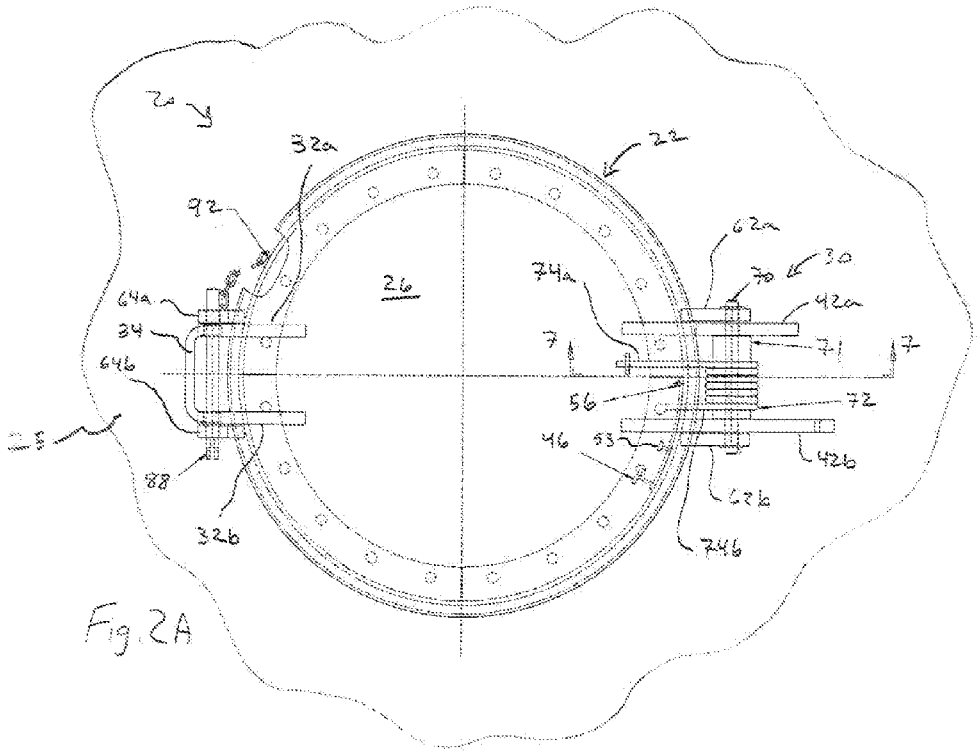
FIG. 2A is a top plan view of the manway cover and nozzle assembly of FIG. 1 including an embodiment of the mechanism of the present invention with the cover in the closed position and a partial view of the railroad tank car tank of FIG. 1 upon which the manway cover and nozzle assembly are installed.
Figure 2B:
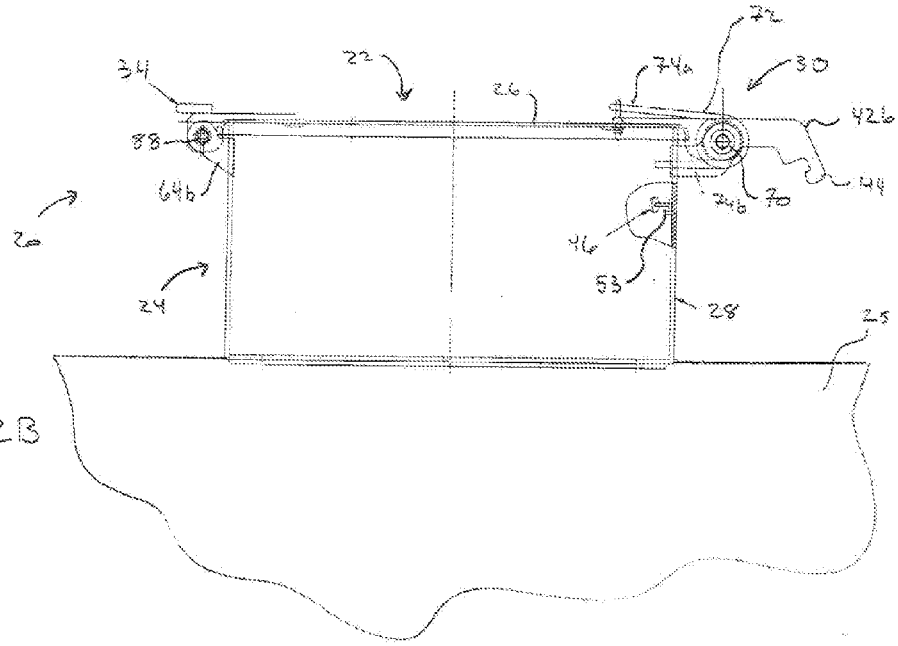
FIG. 2B is a side elevational, partially broken away view of the manway cover and nozzle assembly and railroad tank car tank of FIG. 1.

An enlarged view of the railroad tank car manway cover and nozzle assembly of FIG. 1 equipped with an embodiment of the self-latching cover mechanism of the present invention is indicated in general at 20 in FIGS. 2A and 2B. As illustrated in FIGS. 2A and 2B, the assembly includes a cover assembly, indicated in general at 22, and a nozzle assembly, indicated in general at 24. The nozzle assembly is positioned on the top of the tank (a portion of which is indicated at 25 in FIGS. 2A and 2B) of the tank car of FIG. 1. The cover assembly includes a cover 26 that is attached to the nozzle 28 of the nozzle assembly by a hinge, indicated in general at 30. As will be explained in greater detail below, the cover pivots via the hinge between an open position (illustrated in FIG. 10), wherein the nozzle opening (31 in FIG. 10) is open and the interior of the tank car tank may be accessed, and a closed position, illustrated in FIGS. 2A, 2B and 9, wherein the nozzle opening is covered.

Figure 3:
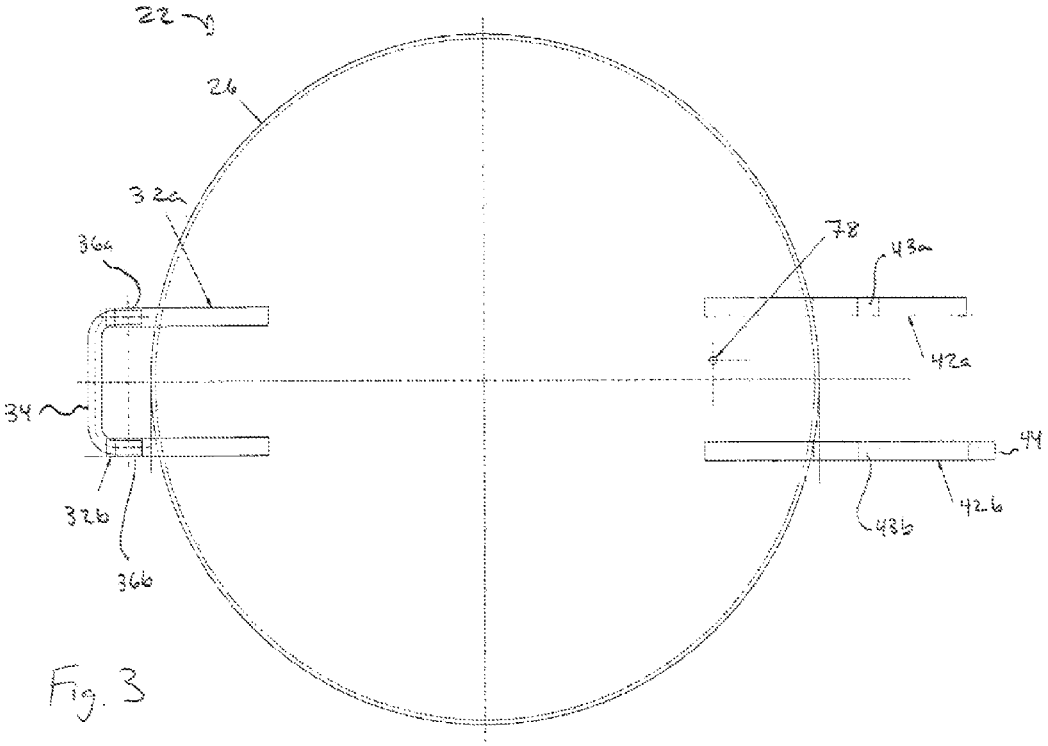
FIG. 3 top plan view of the cover assembly of the manway cover and nozzle assembly of FIGS. 2A and 2B.
Figure 4:
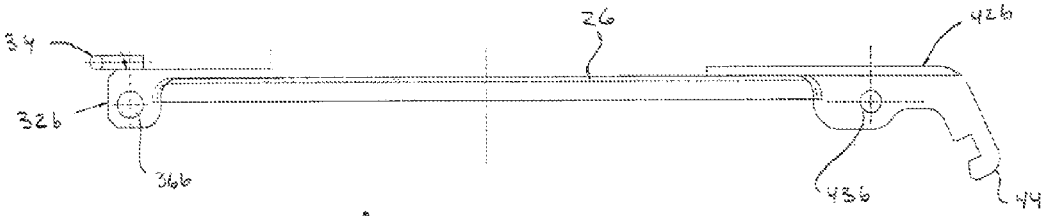
FIG. 4 is a side elevational view of the cover assembly of FIG. 3.

As illustrated in FIGS. 3 and 4, the cover assembly 22 includes a cover 26 to which a pair of cover locking lugs 32*a* and 32*b* are attached. A handle 34 joins the distal end portions of the locking lugs. The cover locking lugs are provided with locking pin openings 36*a* and 36*b*. The cover assembly also includes cover hinge lugs 42*a* and 42*b*. The cover hinge lugs are provided with openings 43*a* and 43*b*. The distal end portion of cover hinge lug 42*b* is provided with a catch member such as hook portion 44. The catch member may be any configuration that may be engaged to hold the cover in an open position (as explained below).

Figure 5:
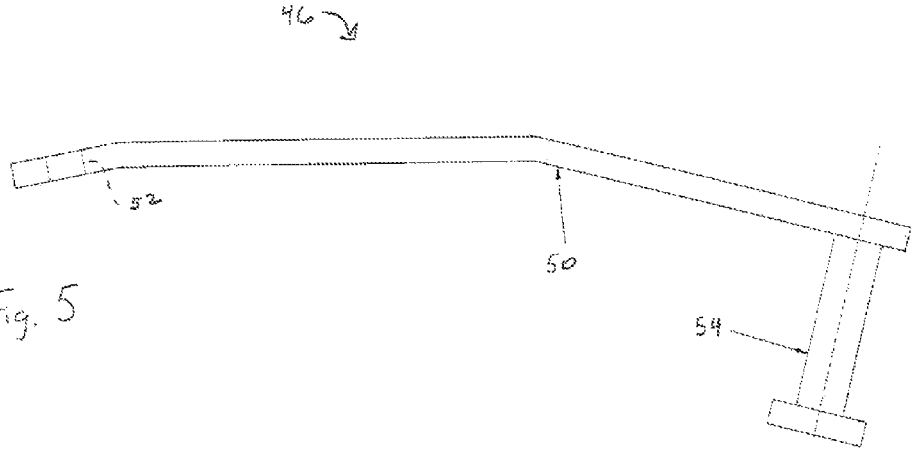
FIG. 5 is top plan view of the latching arm of the manway cover and nozzle assembly of FIGS. 2A and 2B.
Figure 6:
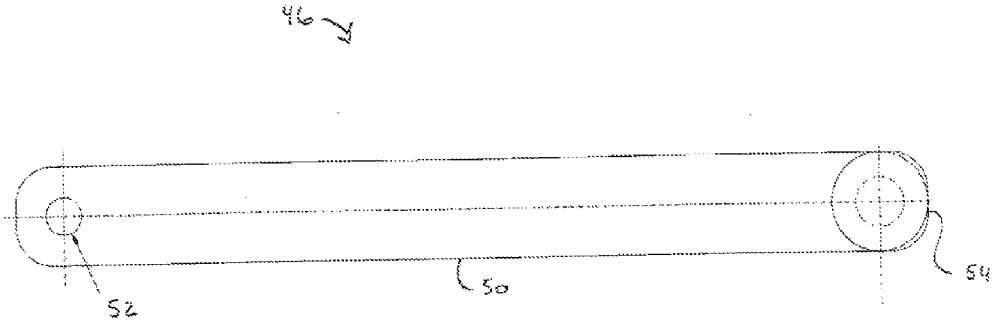
FIG. 6 is a side elevational view of the latching arm of FIG. 5.

As illustrated in FIGS. 2A (in phantom), 2B and 11A-11C, the interior of the nozzle 28 is provided with a latching arm 46. The latching arm is also indicated in general at 46 in FIGS. 5 and 6. The latching arm includes a flat bar member 50 having a proximal end portion with an opening 52 (FIG. 6). As best illustrated in FIG. 5, the flat bar member 50 is provided with a bend and is angled to follow the curve of the inner surface of the nozzle side wall. The distal end portion of the latching arm is provided with a latching handle 54. As illustrated in FIGS. 1 (in phantom) and 11A, the proximal end portion of the latching arm 46 is pivotally secured to the inner surface of the nozzle via a bolt 56 that passes through the opening 52 (FIG. 6) of the flat bar member. A resting pin 53 (FIGS. 1, 2 and 11A) is provided to support the latching arm when it is not latching the cover in the open position. The functionality of the latching arm as part of the self-latching cover mechanism will be explained below.

As illustrated in FIGS. 1 and 2, the nozzle assembly includes, in addition to nozzle 28, a pair of nozzle hinge lugs 62*a* and 62*b*, and a pair of nozzle locking lugs 64*a* and 64*b*, each having aligned openings there through. The cover hinge lugs 42*a* and 42*b* are received between the nozzle hinge lugs 62*a* and 62*b* and are secured together by a hinge pin 70 that passes through the openings of each of the hinge lugs. The hinge pin 70 is provided with a collar 71 (FIGS. 7 and 8).

Figure 7:
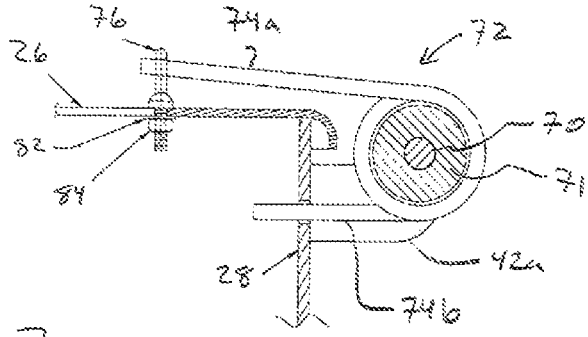
FIG. 7 is an enlarged, cross sectional view of the hinge assembly of the manway cover and nozzle assembly taken along line 7-7 of FIG. 2A.
Figure 8:
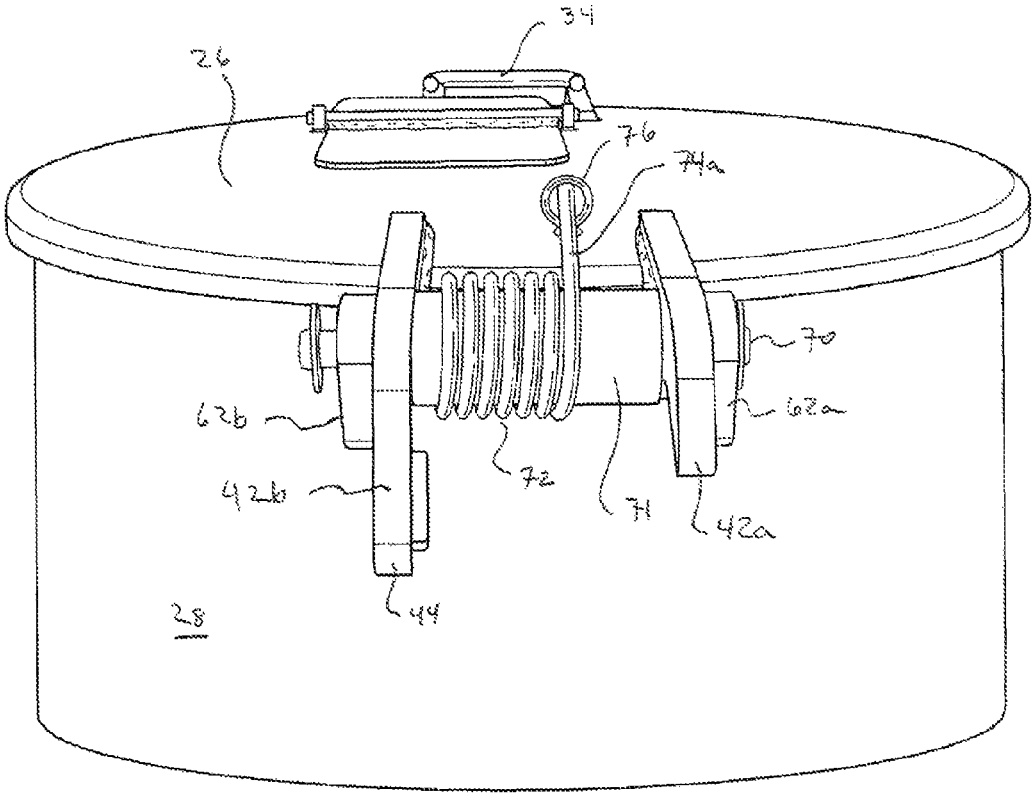
FIG. 8 is a side elevational view of the hinge side of the manway cover and nozzle assembly of FIGS. 2A and 2B with the cover in the closed position.

As illustrated in FIGS. 7 and 8 (as well as 1 and 2), a hinge spring 72 is positioned on collar 71 and features a first leg portion 74*a* and a second leg portion 74*b*. First leg portion 74*a* of the hinge spring is secured to the cover 26 by a fastener 76 featuring a loop portion that receives the spring first leg portion 74*a* and a threaded portion (FIG. 7) that passes through an opening 78 (FIG. 3) formed in the cover 26. As illustrated in FIG. 7, a washer 82 and a nut 84 secure the fastener 76 in place on the cover. As shown in FIGS. 7 and 11A (and FIGS. 1 and 2) the second leg portion 74*b* of the spring passes through an opening in the nozzle side wall. As a result, the hinge spring 72 is held in tension and urges the lid into the open position (illustrated in FIG. 10) thus assisting a user opening the lid. Alternative hinge spring arrangements known in the art may be use, or the hinge spring may be eliminated in its entirety.

As shown in FIGS. 1 and 2, the cover locking lugs 32*a* and 32*b* are positioned between the nozzle locking lugs 64*a* and 64*b* when the cover is in the closed position. As a result, as illustrated in FIGS. 1 and 2, when the cover is in a closed position, a locking pin 88, which is secured to the nozzle by chain 92 (FIG. 2A) to prevent loss, may be removably placed through the aligned openings of the cover locking lugs and the nozzle locking lugs to lock the cover in the closed position.

Figure 9:
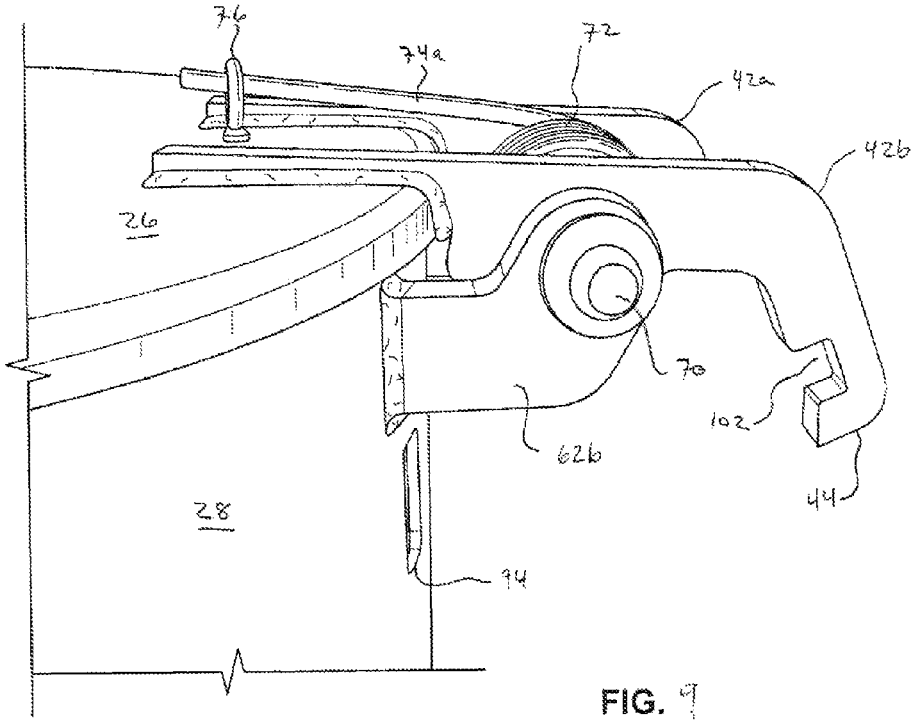
FIG. 9 is an enlarged, partial rear perspective view of the hinge assembly and the manway cover and nozzle assembly of FIG. 8 with the cover in the closed position.

Operation of the self-latching cover mechanism of FIGS. 1-8 will now be explained. The cover 26 is illustrated in the closed position in FIGS. 8 and 9. As illustrated in FIG. 9, the nozzle 28 is provided with a window 94, as part of the self-latching cover mechanism. When the cover is in the closed position, as illustrated in FIG. 9, the hook portion 44 of cover hinge lug 42*b* is positioned outside of the window 94 of the nozzle 28. As illustrated in FIG. 11A, the latching arm 46 partially covers the window 94 inside of the nozzle when the cover is in the closed position and rests on the resting pin 53.

Figure 10:
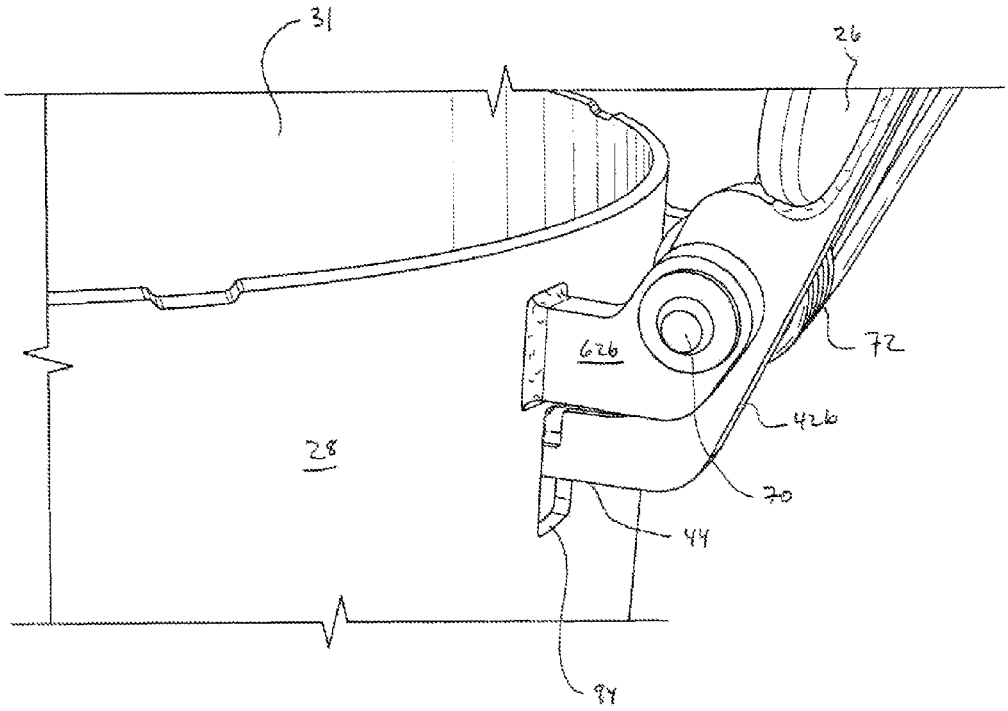
FIG. 10 is an enlarged, partial rear perspective view of the hinge assembly and the manway cover and nozzle assembly of FIG. 8 with the cover in the open position.
Figure 11A:
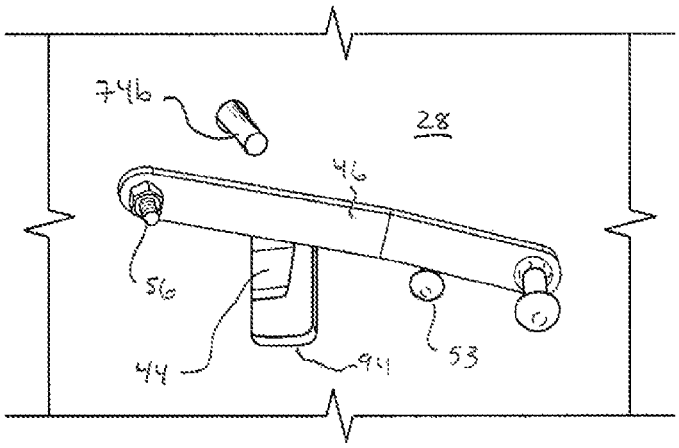
FIGS. 11A-11C illustrate the positions of the hook portion of one of the cover hinge lugs and the latching arm as the cover is being moved from the closed to the open positions.

The cover 26 is illustrated in the open position in FIG. 10. In this position, as illustrated in FIG. 10, the hook portion 44 of cover hinge lug 42*b* passes through the window 94 of the nozzle 28. The implications of this, with respect to the latching arm, will now be explained with reference to FIGS. 11A-11C.

Figure 11B:
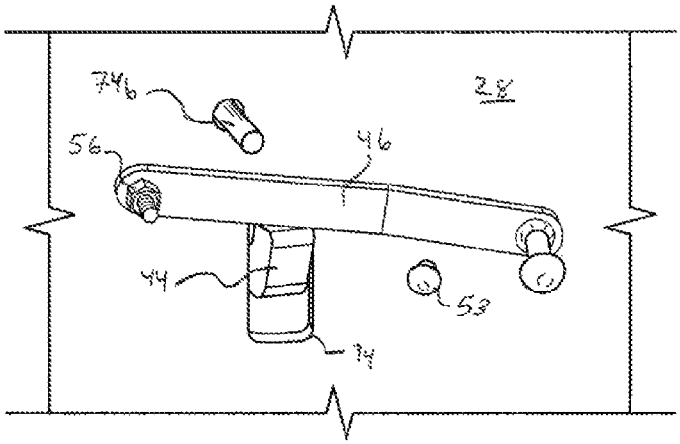

With reference to FIG. 11A, as explained above, when the cover is in the closed position (FIG. 9), the hook portion 44 of the cover hinge lug does not pass through the window 94 of the nozzle. As the cover 26 is raised off of the nozzle 28 and begins to pivot from closed position of FIG. 9 to the open position of FIG. 10, the hook portion 44 of the cover hinge lug 42*b* (FIGS. 9 and 10) pivots clockwise about pin 70 and begins to enter the window 94 of the nozzle, as illustrated in FIG. 11B. As this occurs, as illustrated in FIG. 11B, the hook portion 44 engages the underside of the latching arm 46 and pivots it counterclockwise around bolt 56 so that it is lifted off of resting pin 53.

Figure 11C:
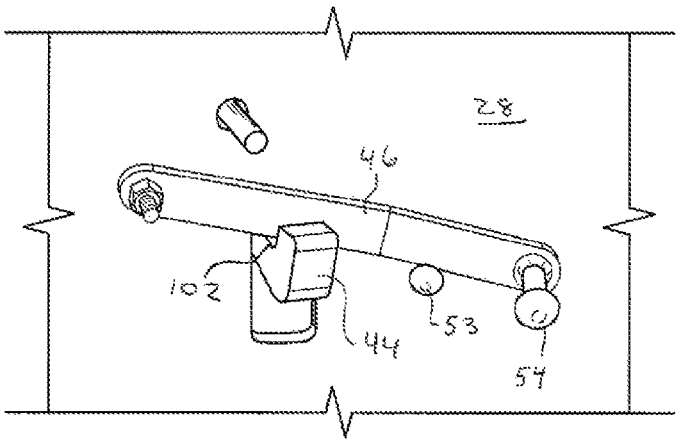

As the cover is pivoted into the open position illustrated in FIG. 10, the hook portion 44 moves into the position illustrated in FIG. 11C whereby the latching arm engages the notch 102 (see also FIG. 9) of the hook portion. As a result, the hook portion 44 is latched by the latching arm 46 so that the hook portion is retained within the nozzle, and the cover is retained in the open position (FIG. 10). A user may then climb through the manway nozzle of the tank car without concern that the cover 26 will accidently fall on him or her or into the closed position while they are in the tank of the tank car. In other embodiments, where the self-latching mechanism is used to cover fittings on a railroad tank car or the like, the user may access the fittings without fear of the cover falling on his or her arms or otherwise striking the user.

When the user wishes to close the cover, i.e. move it from the open position illustrated in FIG. 10 to the closed position of FIG. 9, he or she grasps latching arm handle 54 (FIG. 11C) and pivots it counterclockwise with one hand while grasping the cover handle (34 in FIGS. 1-4) with other. As a result the latching arm 46 disengages the notch 102 of the hook portion of the cover hinge lug, and the cover may be lowered into the closed position illustrated in FIG. 9.

While the preferred embodiments of the invention have been shown and described, it will be apparent to those skilled in the art that changes and modifications may be made therein without departing from the spirit of the invention, the scope of which is defined by the appended claims.

What is claimed is:

1. A nozzle and cover assembly for a tank comprising:

a. a nozzle defining a central opening that provides access to an interior of the tank said nozzle having a sidewall with a window therethrough;

b. a cover;

c. a hinge pivotally attaching the cover to the nozzle so that said cover may be pivoted between an open position, where the central opening is generally uncovered, and a closed position, where the central opening is generally covered by the cover;

d. a catch member attached to the cover, said catch member passing through the window when the cover is pivoted into the open position;

e. a latching arm movably attached to an interior surface of the nozzle sidewall, said latching arm engaging the catch member after it passes through the window to lock the cover in the open position.

2. The nozzle and cover assembly for a tank of claim 1 wherein the catch member is a hook portion that includes a notch.

3. The nozzle and cover assembly for a tank of claim 2 wherein the notch of the hook portion is engaged by the latching arm when the cover is in the open position.

4. The nozzle and cover assembly for a tank of claim 2 wherein the hinge includes a pair of cover hinge lugs and a pair of nozzle hinge lugs, wherein the pair of cover hinge lugs and the pair of nozzle hinge lugs are joined by a hinge pin and one of said cover hinge lugs includes the hook portion.

5. The nozzle and cover assembly for a tank of claim 1 further comprising a spring positioned adjacent to the hinge, said spring having a first leg portion that engages the cover and a second leg portion that engages the nozzle, said spring urging the cover towards the open position.

6. The nozzle and cover assembly for a tank of claim 1 wherein the tank is a railroad tank car tank.

7. A self-latching cover mechanism comprising:

a. a nozzle having a central opening and a sidewall with a widow therethrough;

b. a cover;

c. a hinge pivotally attaching the cover to the nozzle so that said cover may be pivoted between an open position, where the central opening is generally uncovered, and a closed position, where the central opening is generally covered by the cover;

d. a catch member attached to the cover, said catch member passing through the window when the cover is pivoted into the open position; and e. a latching arm movably attached to the interior surface of the nozzle sidewall, said latching arm engaging the catch member after it passes through the window to lock the cover in the open position.

8. The self-latching cover mechanism of claim 7 wherein the catch member is a hook portion that includes a notch.

9. The self-latching cover mechanism of claim 8 wherein the notch of the hook portion is engaged by the latching arm when the cover is in the open position.

10. The self-latching cover mechanism of claim 9 wherein the hinge includes a pair of cover hinge lugs and a pair of nozzle hinge lugs, wherein the pair of cover hinge lugs and the pair of nozzle hinge lugs are joined by a hinge pin and one of said cover hinge lugs includes the hook portion.

11. The self-latching cover mechanism of claim 8 wherein the nozzle includes a sidewall having a window and the latching arm is attached to an interior surface of the nozzle sidewall and the hook portion that passes through the window and the notch of the hook portion is engaged by the latching arm when the cover is in the open position.

12. The self-latching cover mechanism of claim 11 wherein the hinge includes a pair of cover hinge lugs and a pair of nozzle hinge lugs, wherein the pair of cover hinge lugs and the pair of nozzle hinge lugs are joined by a hinge pin and one of said cover hinge lugs includes the hook portion.

13. The self-latching cover mechanism of claim 7 further comprising a spring positioned adjacent to the hinge, said spring having a first leg portion that engages the cover and a second leg portion that engages the nozzle, said spring urging the cover towards the open position.

14. A railroad tank car comprising:

a. a tank;

b. a plurality of wheel trucks supporting said tank;

c. a nozzle having a central opening that provides access to an interior of the tank and a sidewall with a window therethrough;

d. a cover;

e. a hinge pivotally attaching the cover to the nozzle so that said cover may be pivoted between an open position, where the central opening is generally uncovered, and a closed position, where the central opening is generally covered by the cover;

f. a catch member attached to the cover, said catch member passing through the window when the cover is pivoted into the open position; and g. a latching arm movably attached to an interior surface of the nozzle sidewall, said latching arm engaging the catch member after it passes through the window to lock the cover in the open position.

15. The railroad tank car of claim 14 wherein the catch member is a hook portion that includes a notch.

16. The railroad tank car of claim 15 wherein the notch of the hook portion is engaged by the latching arm when the cover is in the open position.

17. The railroad tank-car of claim 16 wherein the hinge includes a pair of cover hinge lugs and a pair of nozzle hinge lugs, wherein the pair of cover hinge lugs and the pair of nozzle hinge lugs are joined by a hinge pin and one of said cover hinge lugs includes the hook portion.

18. The railroad tank car of claim 15 wherein the nozzle includes a sidewall having a window and the latching arm is attached to an interior surface of the nozzle sidewall and the hook portion that passes through the window and the notch of the hook portion is engaged by the latching arm when the cover is in the open position.

19. The railroad tank car of claim 18 wherein the hinge includes a pair of cover hinge lugs and a pair of nozzle hinge lugs, wherein the pair of cover hinge lugs and the pair of nozzle hinge lugs are joined by a hinge pin and one of said cover hinge lugs includes the hook portion.

* * * * *